US010195806B2

(12) United States Patent
Roiss

(10) Patent No.: US 10,195,806 B2
(45) Date of Patent: Feb. 5, 2019

(54) SCREW PRESS SEPARATOR AND METHOD FOR OPERATING THE SCREW PRESS SEPARATOR

(71) Applicant: Röhren—und Pumpenwerk Bauer Ges.m.b.H., Voitsberg (AT)

(72) Inventor: Otto Roiss, Graz (AT)

(73) Assignee: RÖHREN—UND PUMPENWERK BAUER GES.M.B.H. (AT)

( * ) Notice: Subject to any disclaimer, the term of this patent is extended or adjusted under 35 U.S.C. 154(b) by 792 days.

(21) Appl. No.: 14/760,088

(22) PCT Filed: Jan. 2, 2014

(86) PCT No.: PCT/EP2014/050018
§ 371 (c)(1),
(2) Date: Jul. 9, 2015

(87) PCT Pub. No.: WO2014/108349
PCT Pub. Date: Jul. 17, 2014

(65) Prior Publication Data

US 2016/0001516 A1 Jan. 7, 2016

(30) Foreign Application Priority Data

Jan. 9, 2013 (EP) ..... 13000088

(51) Int. Cl.
*B30B 9/12* (2006.01)
*B30B 9/26* (2006.01)

(52) U.S. Cl.
CPC ..... *B30B 9/121* (2013.01); *B30B 9/12* (2013.01); *B30B 9/26* (2013.01)

(58) Field of Classification Search
CPC ..... B30B 9/12–9/18; C02F 11/125
See application file for complete search history.

(56) References Cited

U.S. PATENT DOCUMENTS 4,844,799 A 7/1989 Lee
5,357,855 A 10/1994 Ishigaki et al.
(Continued)

FOREIGN PATENT DOCUMENTS

JP 8-1390 A 1/1996
JP 2003-33896 A 2/2003
(Continued)

OTHER PUBLICATIONS

Machine Translation of JP2004-066306, Translated Apr. 5, 2018, 7 Pages.*
(Continued)

*Primary Examiner* — Jimmy T Nguyen
*Assistant Examiner* — Gregory Swiatocha
(74) *Attorney, Agent, or Firm* — Kolisch Hartwell, P.C.

(57) ABSTRACT

An embodiment of a screw press separator for separating a slurry containing solid and liquid components has a housing and a cylindrical screen, which is arranged in the housing and on which a longitudinal direction and a circumferential direction are defined. The screen is rotatable about the longitudinal direction. The separator also includes a screw arranged inside the screen for pressing out the slurry, the screw being rotatable about the longitudinal direction, at least one retaining element arranged in the housing, at least one actuator adapted to move the at least one retaining element between a locking position and a freewheeling position, and at least one stop connected to the screen. The separator is configured so that the screen is rotationally fixed in at least a circumferential direction in the locking position and the screen co-rotates with the screw in the freewheeling position.

17 Claims, 4 Drawing Sheets

(56) References Cited

U.S. PATENT DOCUMENTS

| | | | | |
|---|---|---|---|---|
| 6,615,710 | B1 | 9/2003 | Ishigaki et al. | |
| 9,561,978 | B2 * | 2/2017 | Theodoulou | C02F 11/125 |
| 2009/0057235 | A1 * | 3/2009 | Sugaya | C02F 11/125 210/709 |
| 2011/0186499 | A1 * | 8/2011 | Czwaluk | B30B 9/12 210/225 |

FOREIGN PATENT DOCUMENTS

| | | | | | |
|---|---|---|---|---|---|
| JP | 2004-66306 | A | | 3/2004 | |
| JP | 200466306 | A | * | 3/2004 | B30B 9/12 |
| JP | 200651516 | A | * | 2/2006 | |
| KR | 101106168 | B1 | * | 1/2012 | B30B 9/14 |

OTHER PUBLICATIONS

Jun. 12, 2013, Extended European Search Report from the European Patent Office in European Patent Application No. 13000088.8, which this U.S. national phase application claims the benefit of priority.

Feb. 24, 2014, International Search Report of the International Search Authority from The European Patent Office, in PCT/EP2014/050018, which is the international application to this U.S. national phase application.

* cited by examiner

Section A-A

SCREW PRESS SEPARATOR AND METHOD FOR OPERATING THE SCREW PRESS SEPARATOR

CROSS-REFERENCE TO RELATED APPLICATIONS

This application is a national phase application of PCT/EP2014/050018, filed Jan. 2, 2014, which claims priority to European Patent Application No. 13000088.8, filed Jan. 9, 2013, each of which is hereby incorporated by reference.

INTRODUCTION

The present invention refers to a screw press separator for separating solid components from a slurry containing solid and liquid components, and to a method for operating the screw press separator.

Screw press separators comprise a cylindrical screen. A rotating screw is arranged in the screen. The slurry inside the screen is pressed out by the screw, so that the liquid components pass through the cylindrical surface of the screen. A plug of solids forms on the front end of the screen. Wastewaters from municipal, industrial or agricultural enterprises (e.g. liquid manure or municipal sewage sludge treated with flocculants) are used as slurries. During operation the screen must be cleaned at regular intervals.

It is the object of the present invention to provide a screw press separator which allows low-maintenance operation together with inexpensive production and assembly. The cylindrical screen should be rotatable together with the screw especially for cleaning purposes. Furthermore, it is the object of the present invention to indicate a corresponding method for operating the screw press separator.

This object is achieved with the features of the independent claims. The dependent claims are concerned with advantageous developments of the invention. Hence, the object is achieved by a screw press separator for separating solid components from a slurry containing solid and liquid components. Wastewaters from municipal, industrial or agricultural enterprises are used as slurry; these are stabilized with flocculants, if necessary. The screw press separator comprises a housing and a cylindrical screen arranged in the housing. Furthermore, a screw is rotatably supported in the housing. The screw extends at least in part into the cylindrical screen. A longitudinal direction and a circumferential direction are defined in conformity with the cylindrical shape of the screen. The screw is rotatably supported about the longitudinal axis. For cleaning the screen it is provided that the screen is rotatably supported about the longitudinal axis. The screen does not require a drive of its own because with a sufficient solids content between the screw and the screen a torque is transmitted from the screw to the screen. According to the invention at least one retaining element is arranged in the housing, particularly between a housing wall and the cylindrical surface of the screen. Furthermore, an actuator is provided. With the help of the actuator the retaining element can be moved into a locking position and into a freewheeling position. An end of the actuator is particularly firmly connected to the housing. The other end of the actuator is connected to the retaining element. At least one fixed stop is provided on the screen, particularly on the cylindrical surface of the screen. When the retaining element is in the locking position, the stop lies on the retaining element so that the screen is rotationally fixed in at least one direction. This "locking position" is also called "working position." In the locking or working position the screen is rotationally fixed and the slurry can be pressed out by rotation of the screw. For cleaning the screen the at least one retaining element is moved by means of the actuator into the freewheeling position. The retaining element thereby moves away from the stop. In the freewheeling position the screen rotates with the screw. It is thereby possible to clean the screen from all sides. Hence, according to the invention the retaining element is moved actively, with the actuator, into the locking position and freewheeling position. The retaining element and the matching stop on the screen can operate over the whole length of the screen, so that the force between the retaining element and the stop is transmitted over an area that is as large as possible. Furthermore, it is possible according to the invention that the screw rotates in the same direction when the slurry is pressed out and also when the screen is cleaned.

Preferably, it is provided that the retaining element is designed as a retaining rail extending in longitudinal direction. The retaining rail extends in longitudinal direction over a retaining element length. The screen extends in longitudinal direction over a screen length. Preferably, it is provided that the retaining element length is at least 50%, preferably at least 75%, particularly at least 100%, of the screen length. Furthermore, it is preferably provided that the stop or the plural stops extend over at least 50%, preferably over at least 75%, particularly preferably over at least 95%, of the retaining element length.

By using a retaining rail as the retaining element, the force between stop and retaining element is transmitted over an area that is as large as possible. Since the screen is non-rotatably supported not only at its front ends, but also along its whole length on the retaining rail, the screen does not require a very stiff structure. This has decisive advantages when the slurry is pressed out. The reason is that when the slurry is pressed out, the screen undergoes an elliptical deformation, depending on the position of the mostly double-type screw and/or on the amount of the solid. Owing to the design of the screw press separator according to the invention the screen can be made relatively unstable, so that said deformation is possible while the slurry is being pressed out. Furthermore, the gap between the screw wings and the inner diameter of the screen can be kept as small as possible because a contact between the screw wings and the screen is effectively avoided.

The retaining rail is arranged preferably in parallel with the longitudinal direction. When the retaining rail is moved into the freewheeling position, the retaining rail is moved away outwards from the cylindrical surface of the screen. Specifically, this movement takes place in a radial direction perpendicular to the longitudinal direction.

The retaining rail is arranged both in the locking position and in the freewheeling position in parallel with the longitudinal direction. To this end the retaining rail is preferably supported via at least one guide element in the housing. This guide element preferably comprises a cylinder fixed to the housing, in which a piston is guided. The piston is connected to the retaining rail.

Preferably, plural washing nozzles that are distributed along the longitudinal direction are arranged in the housing. With these washing nozzles, water can be sprayed from the outside onto the screen in order to clean the screen. Since during cleaning the screen is rotating, it is enough to arrange just a number of washing nozzles.

Furthermore, a sensor is preferably provided for sensing a rotation angle and/or a rotation speed of the screen. The movement of the at least one retaining element from the freewheeling position into the locking position is preferably carried out in response to the data sensed by the sensor. It is thereby ensured that the retaining element moves at the right time into the locking position, so that the stop abuts on the retaining element.

Furthermore, it is preferably provided that a plurality of retaining elements is provided along the circumferential direction of the screen. At least one actuator and at least one stop, which is fixedly connected to the screen, are provided for each retaining element.

The actuator is operated preferably hydraulically, pneumatically or electrically.

The screw preferably comprises a conical screw core and at least one screw helix arranged on the screw core. Furthermore, an inlet for the slurry is provided on the screw press separator on a front side of the cylindrical screen. A solids outlet is formed on the other front side of the screen. The conical screw core tapers preferably towards the inlet. A cone ring which regulates the discharge amount of the solid is preferably arranged at the solids outlet.

The invention further comprises a method for operating the presented screw press separator. The following steps are here taken: (i) pressing out the slurry, with the screw rotating and the retaining element being in the locking position, (ii) moving the retaining element into the freewheeling position, (iii) rotating the screw while the retaining element is in the freewheeling position, so that the screen rotates with the screw, and (iv) cleaning the screen while the screen is rotating with the screw.

Before the retaining element is moved into the freewheeling position, the drive of the screw is preferably switched off for a short time. As soon as the retaining element is in the freewheeling position, the screw is again rotated. Specifically, the screw rotates for pressing out the slurry and also for cleaning the screen in the same direction. For cleaning the screen the aforementioned washing nozzles are particularly activated. The rotation of the screen is monitored with the sensor. The sensor transmits a certain rotation path of the screen to the actuator. The actuator correspondingly moves the retaining element back into the locking position. The screen is thereby captured by the retaining elements and prevented from further rotating. Thereupon, the slurry can be pressed out again.

The retaining elements can also be adjusted for maintenance work, for instance in order to prevent the screen from falling down while the screw is disassembled.

The sub-claims of the screw press separator according to the invention and the presented configurations of the screw press separator are advantageously used in a corresponding manner in the method according to the invention.

An embodiment of the invention shall now be explained with reference to the accompanying drawing in detail, in which:

DETAILED DESCRIPTION OF THE FIGURES

Figure 1:
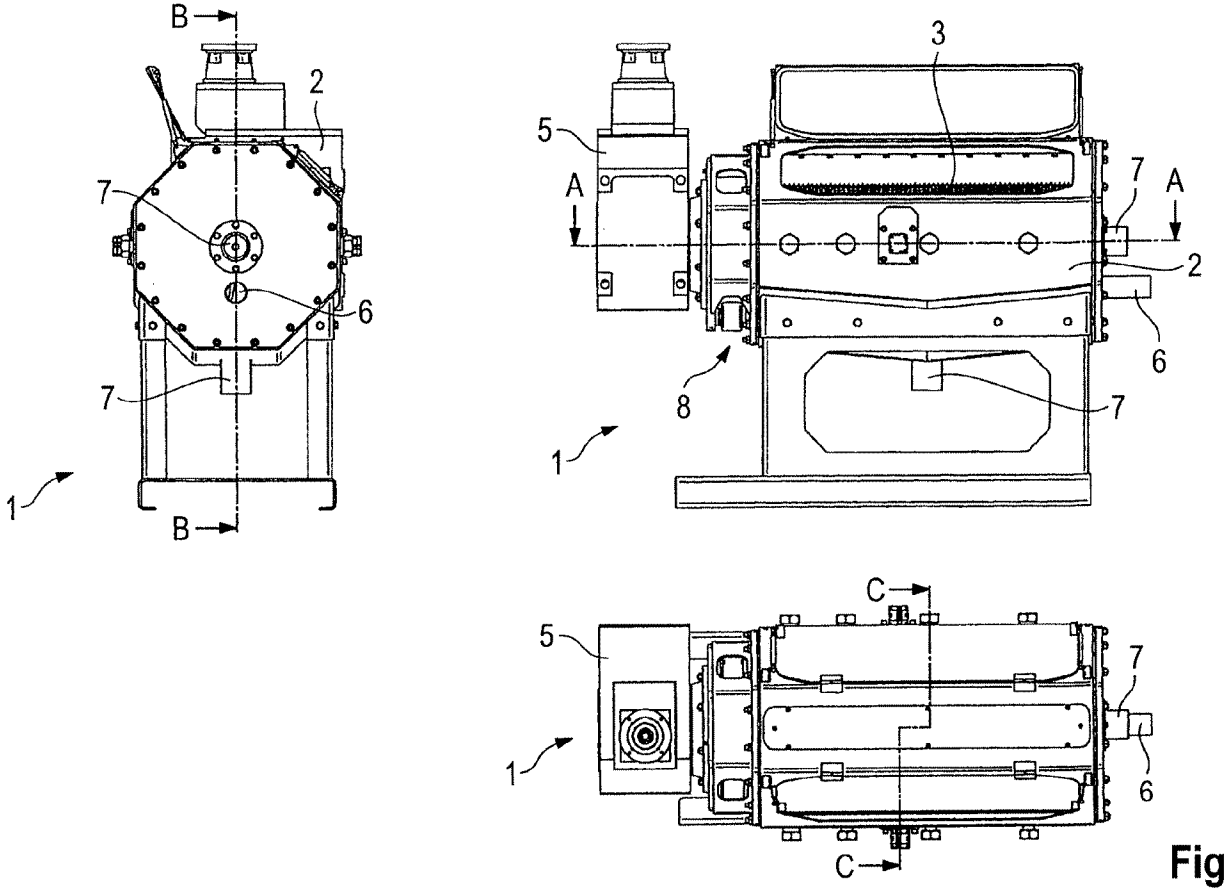
FIG. 1 shows three views of a screw press separator of the invention according to an embodiment.
Figure 2:
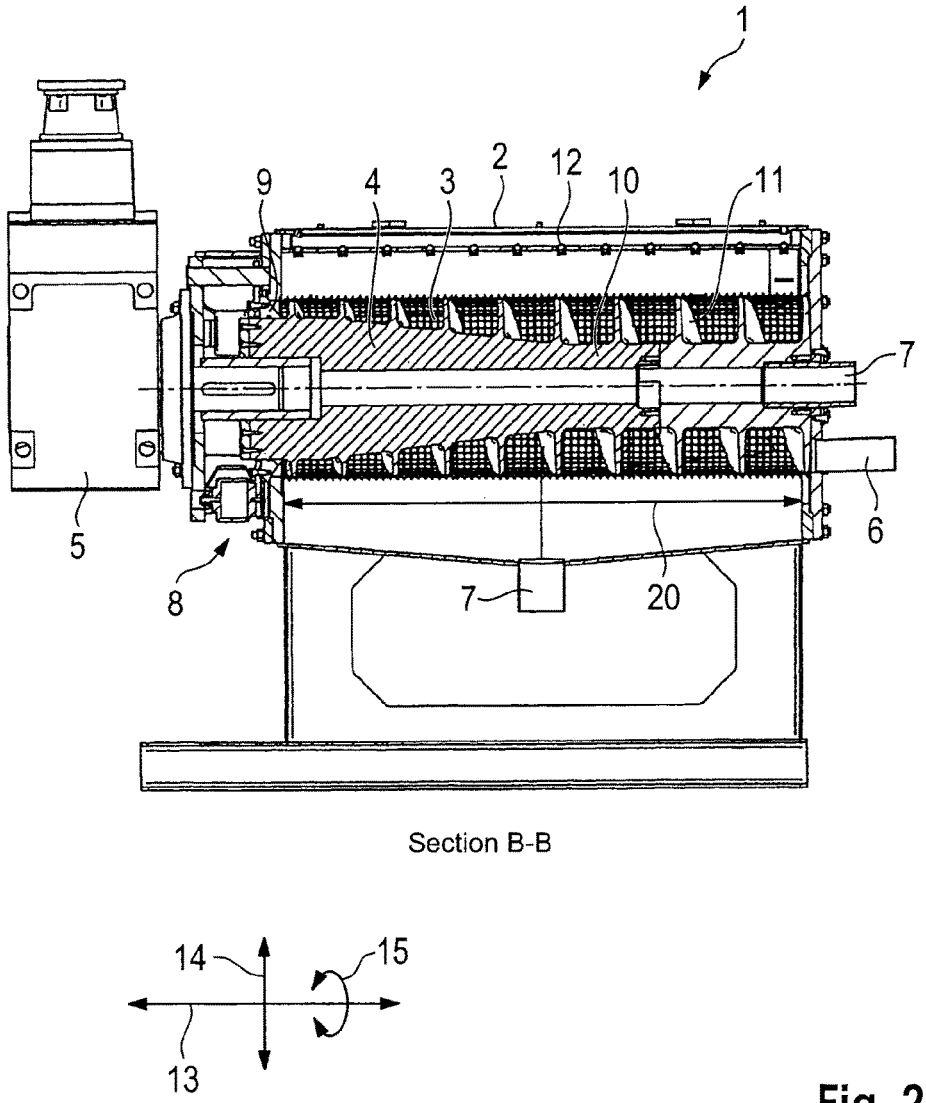
FIG. 2 shows section B-B marked in FIG. 1.
Figure 3:
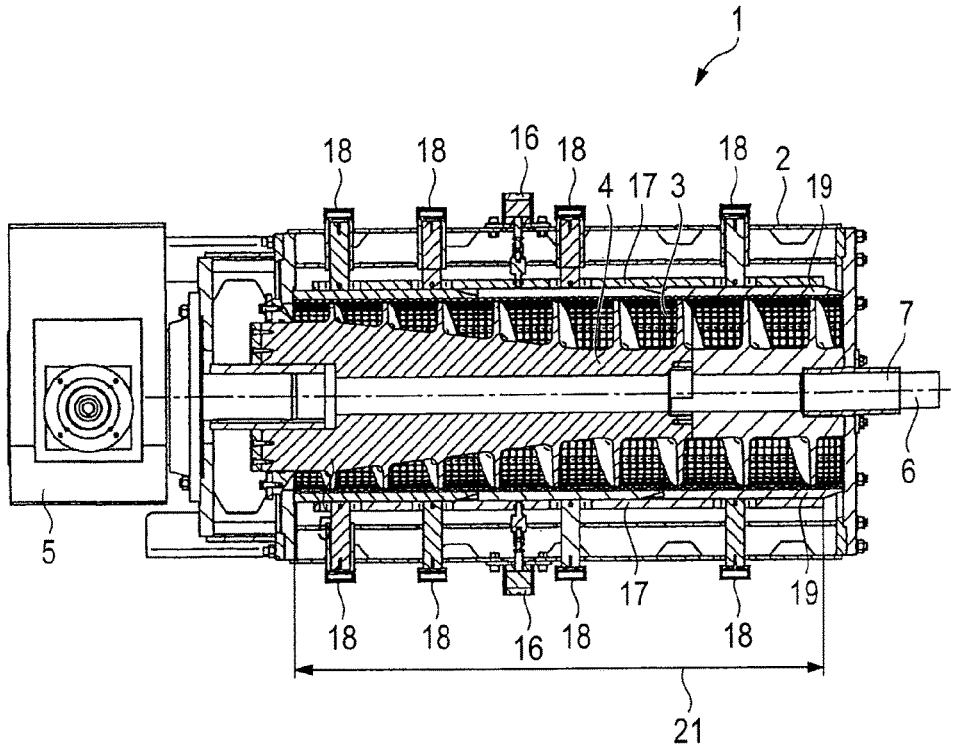
FIG. 3 shows section A-A marked in FIG. 1.
Figure 3:
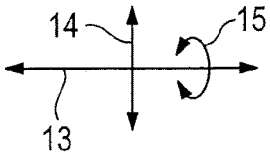
Figure 4:
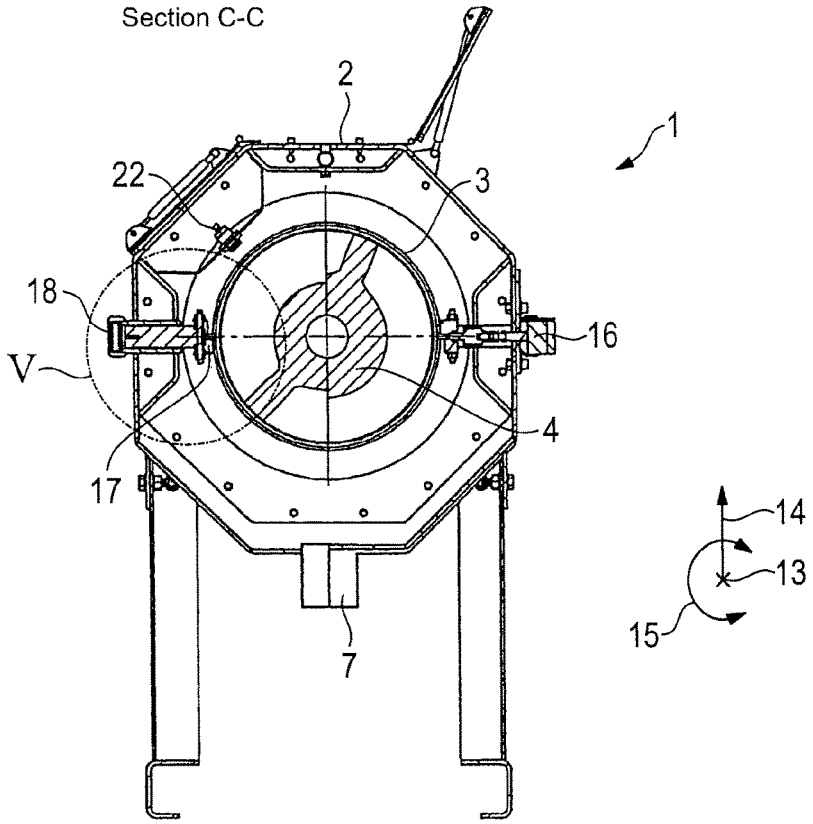
FIG. 4 shows section C-C marked in FIG. 1.
Figure 5:
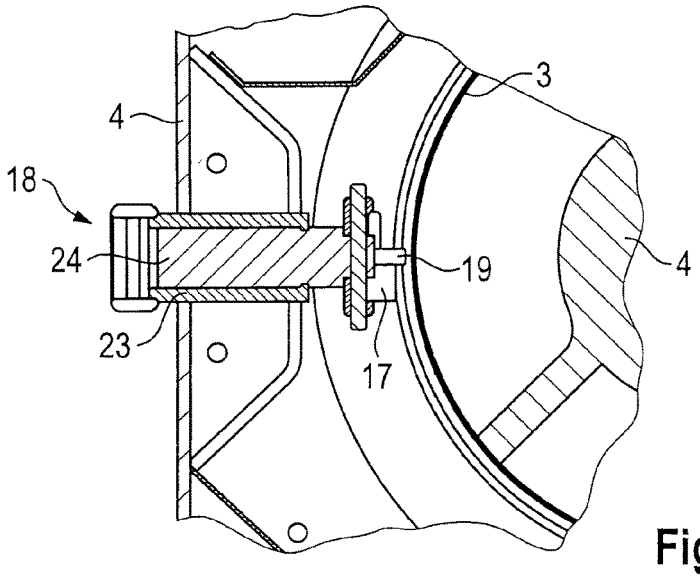
FIG. 5 shows detail V marked in FIG. 4.

An embodiment of a screw press separator 1 will now be shown with reference to FIGS. 1 to 5. FIG. 1 shows three different views of the screw press separator 1. FIGS. 2 to 3 show the sections marked in FIG. 1. FIG. 5 shows detail V marked in FIG. 4.

The screw press separator 1 comprises a housing 2. A cylindrical screen 3 is arranged in the housing 2. Furthermore, a screw 4 is rotatably supported in the housing 2. The screw 4 extends through the cylindrical screen 3.

A drive 5, formed as an electric motor or hydraulic motor, is provided for rotating the screw 4.

At the right front side of the screen 3 an inlet 6 is formed in the housing. With the help of the inlet 6 the slurry to be pressed out is passed into the interior of the screen 3. A solids outlet 8 is provided at the left front side of the screen 3. An outlet 7 for the liquid components of the slurry is provided at the bottom side of the housing 2. A further outlet 7 is possible at a front end of the hollow screw 4.

The slurry which is supplied via the inlet 6 is pressed out by rotation of the screw 4 from the right side to the left side. A solids plug is thereby formed in the left region. The solid leaves the screw press separator 1 via the solids outlet 8. The separated liquid components flow through the screen 3 outwards, leaving the screw press separator 1 via the outlet 7.

FIG. 2 shows a cone ring 9 at the solids outlet 8. The amount of the discharged solid is regulated through the position of the cone ring 9.

Furthermore, FIG. 2 shows the exact configuration of the screw 4. The screw 4 comprises a screw core 10 and at least one screw helix 11 arranged on the screw core 10. The screw core 10 is made conical, tapering in the direction of the inlet 6.

FIGS. 2-4 show a longitudinal direction 13. The screen 3 and the screw 4 extend in said longitudinal direction 13. The screw 4 is rotated about the longitudinal direction 13 with the help of the drive 5. A radial direction 14 is perpendicular to the longitudinal direction 13. The circumferential direction 15 is defined around the longitudinal direction 13.

Plural washing nozzles 12 are arranged in the housing 2 along the longitudinal direction 13. With the help of the washing nozzles 12 a liquid, particularly water, can be sprayed from the outside onto the screen 3.

FIG. 3 shows two retaining elements 17, shaped as retaining rails. Each of the retaining elements 17 extends in longitudinal direction 13. The retaining elements 17 are firmly connected to the housing 2 via an actuator 16 and via guide elements 18. With the help of the actuator 16 the retaining elements 17 can be moved inwards, in the direction of the screen 3, and outwards, away from the screen 3.

FIG. 3 further shows that stops 19 are formed on the screen 3. The enlarged representation in FIG. 5 shows the exact design of the retaining element 17 and of the stop 19. The illustrated stop 19 is firmly connected to the screen 3. The stop 19 abuts on the retaining element 17. The screen is thereby non-rotatably received. The position shown in the figures is designated as "locking position". With the help of the actuator 16 the retaining element 17 can be moved outwards. The stop 19 thereby no longer abuts on the retaining element 17, whereby a rotation of the screen 3 is possible.

The guide elements 18 comprise a cylinder 23 fixed to the housing. A piston 24 is guided to be linearly movable in said cylinder 23. The piston 24 is connected to the retaining element 17.

FIG. 2 shows a screen length 20 of the screen 3. FIG. 3 shows a retaining element length 21 of the retaining element 17. The retaining element length 21 is made as great as possible, so that the force between the retaining element 17 and the stop 19 can be transmitted over a portion of the screen length 20 that is as great as possible.

FIG. 4 shows a sensor 22. With the help of the sensor 22 the rotational movement of the screen 3 is detected.

When the slurry is pressed out, a solids plug is formed in the annular gap between the screw core 10 and the screen 3. This solids plug transmits a torque from the screw 4 onto the screen 3. When the retaining elements 17 are in the locking position, the screen 3 is rotationally fixed and the slurry can be pressed out. For cleaning the screen 3 the retaining elements 17 are moved outwards, so that the screen 3 rotates together with the screw 4. Hence, the whole circumference of the screen 3 can be cleaned by activating the washing nozzles 12. The sensor 23 senses the rotational movement of the screen 3 and can activate the actuators 16 at the right time, so that the retaining elements 17 are again moved into the locking position.

The present disclosure relates to a screw press separator (1) for separating solid components from a slurry containing solid and liquid components, comprising: a housing (2), a cylindrical screen (3), which is arranged in the housing (2) and on which a longitudinal direction (13) and a circumferential direction (15) are defined, the screen (3) being rotatable about the longitudinal direction (13), a screw (4) arranged inside the screen (3) for pressing out the slurry, the screw (4) being rotatable about the longitudinal direction (13), at least one retaining element (17) arranged in the housing (2), at least one actuator (16) for moving the at least one retaining element (17) between a locking position and a freewheeling position, at least one stop (19) firmly connected to the screen (3), which is designed to abut on the retaining element (17) in the locking position, so that the screen (3) is rotationally fixed in at least a circumferential direction (15) in the locking position and the screen (3) co-rotates with the screw (4) in the freewheeling position.

The present disclosure may include one or more of the following concepts:

A. A screw press separator (1) for separating solid components from a slurry containing solid and liquid components, comprising
   - a housing (2),
   - a cylindrical screen (3), which is arranged in the housing (2) and on which a longitudinal direction (13) and a circumferential direction (15) are defined, the screen (3) being rotatable about the longitudinal direction (13),
   - a screw (4) arranged inside the screen (3) for pressing out the slurry, the screw (4) being rotatable about the longitudinal direction (13),
   - at least one retaining element (17) arranged in the housing (2),
   - at least one actuator (16) for moving the at least one retaining element (17) between a locking position and a freewheeling position,
   - at least one stop (19) firmly connected to the screen (3), which is designed to abut on the retaining element (17) in the locking position, so that the screen (3) is rotationally fixed in at least a circumferential direction (15) in the locking position and the screen (3) co-rotates with the screw (4) in the freewheeling position.

B. The screw press separator in accordance with paragraph A, characterised by the fact that the retaining element (17) is configured as a retaining rail extending in longitudinal direction (13).

C. The screw press separator in accordance with paragraph B, characterised by the fact that the retaining rail extends in longitudinal direction (13) over a retaining element length (21) and the screen (3) extends in longitudinal direction (13) over a screen length (20), the retaining element length (21) being at least 50%, preferably at least 75%, of the screen length (20).

D. The screw press separator in accordance with paragraphs B or C, characterised by the fact that the stop (19) or the plurality of stops extend over at least 50%, preferably over at least 75%, of the retaining element length (21).

E. The screw press separator in accordance with paragraphs B to D, characterised by the fact that that the retaining rail is arranged in the locking position and in the freewheeling position in parallel with the longitudinal direction (13).

F. The screw press separator in accordance with any of the previous paragraphs, characterised by the fact that that a plurality of washing nozzles (12) that are distributed along the longitudinal direction (13) are arranged in the housing (2).

G. The screw press separator in accordance with any of the previous paragraphs, characterised by the fact that a sensor (22) for sensing a rotation angle and/or a rotation speed of the screen (3).

H. The screw press separator in accordance with any of the previous paragraphs, characterised by the fact that a plurality of retaining elements (17) distributed along the circumferential direction (15) of the screen (3), each comprising at least one actuator (16) and at least one stop (19) fixedly connected to the screen (3).

I. The screw press separator in accordance with any of the previous paragraphs, characterised by the fact that the actuator (16) is operated hydraulically or pneumatically or electrically.

J. The screw press separator in accordance with any of the previous paragraphs, characterised by the fact that the screw (4) comprises a conical screw core (10) and at least one screw helix (11) arranged on the screw core (10).

K. The screw press separator in accordance with any of the previous paragraphs, characterised by the fact that an inlet (6) for the slurry is formed on a front side of the cylindrical screen (3), and a solids outlet (8) is formed on the other front side.

L. A method for operating a screw press separator (1) in accordance with any of the previous paragraphs, comprising the following steps:
   - pressing out a slurry, with the screw (4) rotating and the retaining element (17) being in the locking position,
   - moving the retaining element (17) into the freewheeling position,
   - rotating the screw (4) while the retaining element (17) is in the freewheeling position, so that the screen (3) rotates with the screw (4), and
   - cleaning the screen (3) while the screen (3) is rotating with the screw (4).

LIST OF REFERENCE NUMERALS

1 screw press separator
2 housing
3 screen
4 screw
5 drive
6 inlet
7 outlet
8 solids outlet
9 cone ring
10 screw core
11 screw helix
12 washing nozzles

13 longitudinal direction
14 radial direction
15 circumferential direction
16 actuator
17 retaining element
18 guide element
19 stop
20 screen length
21 retaining element length
22 sensor
23 cylinder
24 piston

What is claimed is:

1. A screw press separator for separating solid components from a slurry containing solid and liquid components, comprising a housing, a cylindrical screen, which is arranged in the housing and on which a longitudinal direction and a circumferential direction are defined, the screen being rotatable about the longitudinal direction, a screw arranged inside the screen for pressing out the slurry, the screw being rotatable about the longitudinal direction, at least one retaining element arranged in the housing, at least one actuator adapted to move the at least one retaining element between a locking position and a freewheeling position, at least one stop connected to the screen, the at least one stop configured to abut on the retaining element in the locking position, so that the screen is rotationally fixed in at least the circumferential direction in the locking position and the screen co-rotates with the screw in the freewheeling position;

wherein a torque is transferable from the screw to the screen via the solid components of the slurry to drive the screen when the retaining element is in the freewheeling position;

wherein each of the at least one retaining elements comprises an elongate retaining rail coupled to the at least one actuator and extending in the longitudinal direction, the at least one actuator adapted to move the elongate retaining rail between the locking position and the freewheeling position in a direction transverse to the longitudinal direction wherein the retaining rail extends in the longitudinal direction over a retaining element length and the screen extends in the longitudinal direction over a screen length, the retaining element length being at least 50% of the screen length; and wherein the at least one stop extends over at least 50% of the retaining element length from first and second ends of the screen.

2. The screw press separator according to claim 1, characterized in that the retaining rail is arranged in the locking position and in the freewheeling position parallel to the longitudinal direction.

3. The screw press separator according to claim 1, characterized in that a plurality of washing nozzles that are distributed along the longitudinal direction are arranged in the housing.

4. The screw press separator according to claim 1, characterized by a sensor for sensing a rotation angle and/or a rotation speed of the screen.

5. The screw press separator according to claim 1, characterized by a plurality of retaining elements distributed along the circumferential direction of the screen, each comprising the at least one actuator.

6. The screw press separator according to claim 1, characterized in that the at least one actuator is operated hydraulically or pneumatically or electrically.

7. The screw press separator according to claim 1, characterized in that the screw comprises a conical screw core and at least one screw helix arranged on the screw core.

8. The screw press separator according to claim 1, characterized in that an inlet for the slurry is formed on the first end of the cylindrical screen, and a solids outlet is formed on the second end of the cylindrical screen.

9. A method for operating the screw press separator according to claim 1, comprising:

pressing out the slurry, with the screw rotating and the at least one retaining element being in the locking position in which the screen cannot co-rotate with the screw, moving the at least one retaining element into the freewheeling position in which the screen is free to rotate with the screw, rotating the screw while the at least one retaining element is in the freewheeling position, so that the screen rotates with the screw, and cleaning the screen while the screen is rotating with the screw.

10. The method for operating the screw press separator according to claim 9, characterized in that the respective retaining rail extends in the longitudinal direction over the retaining element length and the screen extends in the longitudinal direction over the screen length, the respective retaining element length being at least 75% of the screen length.

11. The method for operating the screw press separator according to claim 9, characterized in that the at least one stop extends over at least 75% of the retaining element length.

12. The method for operating the screw press separator according to claim 9, characterized in that a plurality of washing nozzles that are distributed along the longitudinal direction are arranged in the housing.

13. The method for operating the screw press separator according to claim 12, characterized by a sensor for sensing a rotation angle of the screen, a rotation speed of the screen, or both the rotation angle and the rotation speed of the screen.

14. The method for operating the screw press separator according to claim 13, characterized by a plurality of retaining elements distributed along the circumferential direction of the screen, each comprising the at least one actuator.

15. The method for operating the screw press separator according to claim 14, characterized in that the at least one actuator is operated hydraulically or pneumatically or electrically.

16. The method for operating the screw press separator according to claim 15, characterized in that the screw comprises a conical screw core and at least one screw helix arranged on the screw core.

17. The method for operating the screw press separator according to claim 16, characterized in that an inlet for the slurry is formed on the first end of the cylindrical screen, and a solids outlet is formed on the second end of the cylindrical screen.

* * * * *